United States Patent [19]

Gloor et al.

[11] Patent Number: 4,980,951

[45] Date of Patent: Jan. 1, 1991

[54] METHOD AND APPARATUS FOR PARALLELIZING FIBERS

[75] Inventors: René Gloor, Richterswil; Michael Müller, Wädenswil; Alfred Beeler, Horgen, all of Switzerland

[73] Assignee: Siegfried Peyer AG, Wollerau, Switzerland

[21] Appl. No.: 498,629

[22] Filed: Mar. 26, 1990

[30] Foreign Application Priority Data

Apr. 18, 1989 [CH] Switzerland ..... 1468/89

[51] Int. Cl.[5] ..... D01G 25/00; D01G 33/00

[52] U.S. Cl. ..... 19/98

[58] Field of Search ..... 19/97.5, 98, 99

[56] References Cited

U.S. PATENT DOCUMENTS 4,723,343 2/1988 Bernhardt et al. ..... 19/98

FOREIGN PATENT DOCUMENTS 672046 10/1963 Canada ..... 19/98
2110599 of 0000 Fed. Rep. of Germany .
185718 5/1956 Fed. Rep. of Germany ..... 19/98
2204152 11/1988 United Kingdom ..... 19/98

OTHER PUBLICATIONS

Georgi Spiridonow, "Messungen mit Einem Neuen Halbautomatischen Längenmessgerhät und Vergleich mit den Längenkennwereten Bekannter Bauarten", Oct. 1978, pp. 780–782.

*Primary Examiner*—Werner H. Schroeder
*Assistant Examiner*—John J. Calvert
*Attorney, Agent, or Firm*—Walter C. Farley

[57] ABSTRACT

A method for making slivers of fibers with parallelized fibers from sets of tangled or matted fibers includes the steps of winding a pre-measured amount of partially oriented fiber material onto a first carding drum (3), detaching the annular fiber web from the first carding drum (3) at a specific site and separating the web from the drum. The separated fiber web is wound off the first carding drum by the detached free end of the web, and the fiber web is stretched. The stretched fiber web is wound onto a second carding drum (8) folded over onto itself, and the doubled fiber web is detached from the second carding drum at a specific site. The detached fiber web is wound off the second carding drum (8) by the detached free end of the fiber web and the fiber web is again stretched. The stretched fiber web is wound onto the first carding drum and the winding and stretching steps are repeated until satisfactory parallelization has taken place, whereupon the iteration cycle is ended. An apparatus for performing the method is disclosed.

8 Claims, 1 Drawing Sheet

METHOD AND APPARATUS FOR PARALLELIZING FIBERS

SPECIFICATION

This invention concerns a method for making fiber slivers with parallelized fibers from sets of matted or tangled fibers and to an apparatus for accomplishing this method.

BACKGROUND OF THE INVENTION

Many procedures and devices are known to qualitatively and quantitatively test textile fibers. Random fiber material, such as cotton in flock form, cannot be measured directly in many procedures, but instead first must be prepared into slivers of fibers with these fibers being made parallel. Accordingly, such pre-parallelized fibers are the input material to all test means that demand parallelized fibers.

Illustratively such test means are:

fiber aligners implementing the end arrangement of fiber tufts, brushing stations for fiber tufts without end arrangement, tension testers determining tear strength and elongating of bundles, optical scanners such as pictorial data analyzers, fiber-ripeness testers, fiber-fineness testers, fiber grading devices, etc.

Mechanized devices for making such slivers of fibers are already known, illustratively from the special issue by G. Spiridonow in MELLIAND TEXTILBERICHTE 59 (1978). Essentially this known device consists of a plain roller stretcher, that is of a pair of feed rollers and a pair of output rollers. It is clear from this that using such a simple, manually driven device, the manufacture of fiber slivers with parallelized fibers is time-consuming and low in reproducibility. Manual operation demands high skill and moreover entails constant contact between the bare hand and the raw material so that sweat contamination is unavoidable.

SUMMARY OF THE INVENTION

An object of the invention is to provide apparatus for making fiber slivers with parallelized fibers from aggregates of tangled or matted fibers and operating wholly automatically and without damaging the fibers.

A further object is to provide a method for efficiently parallelizing fibers in an aggregate of matted fibers automatically.

Briefly described, the invention comprises a method for making fiber slivers with parallelized fibers from sets of tangled fibers, comprising the sequential steps of (a) feeding and winding a predetermined quantity of tangled fiber material onto a first carding drum to form thereon a fiber web, (b) detaching an end of the fiber web annularly wound on the first carding drum at a selected site, (c) winding off the fiber web from the first carding drum by the detached free end of the fiber web, (d) stretching the fiber web by a factor "x", (e) winding the stretched fiber web onto a second carding drum, (f) detaching the fiber web from the second carding drum at a selected site, (g) winding off the fiber web from the second carding drum by the detached free end of the fiber web, (h) stretching the fiber web by the factor "x", (i) again winding the stretched fiber web onto the first carding drum, (j) repeating the steps (b) through (i) until sufficient parallelization of fibers has taken place, and then (h) terminating the iteration cycle after the next step (g).

In another aspect, the invention comprises an apparatus for parallelizing fibers in a bundle of matted fibers comprising the combination of first and second cylindrical carding drums each having carding mounted on the cylinder surface, and means for selectively driving either of the drums in either rotational direction. A feed means feeds to the first carding drum a pre-measured amount of tangled fiber material and a stretching device is mounted between the first and second carding drums. First conveyor belt means bidirectionally moves the fiber web between the first carding drum and the stretching device and a second conveyor belt means bidirectionally moves the fiber web between the second carding drum and the stretching device. A separation device is mounted for oscillatory movement between the two carding drums. A control system is provided to make the individual components of said apparatus cooperate.

Essentially, the advantages of the invention are that the fiber slivers with parallelized fibers can be made in a fully automatic manner by means of the method and apparatus of the invention, and that the composition of these fiber slivers (i.e., the proportions of fibers of different lengths) substantially matches the fiber population of the representative fiber material.

In particular the method of the invention allows automating the following operations:

continuous stretching and doubling by automatic change in direction feeding, web unraveling drawing into the stretching means, and sliver exit.

BRIEF DESCRIPTION OF THE DRAWING

An illustrative embodiment of the invention explaining the principle of operation is shown in the drawing and is further elucidated below, the drawing being a schematic side elevation of an apparatus in accordance with the invention with which to implement the method of the invention.

DESCRIPTION OF THE PREFERRED EMBODIMENT

Figure 1:
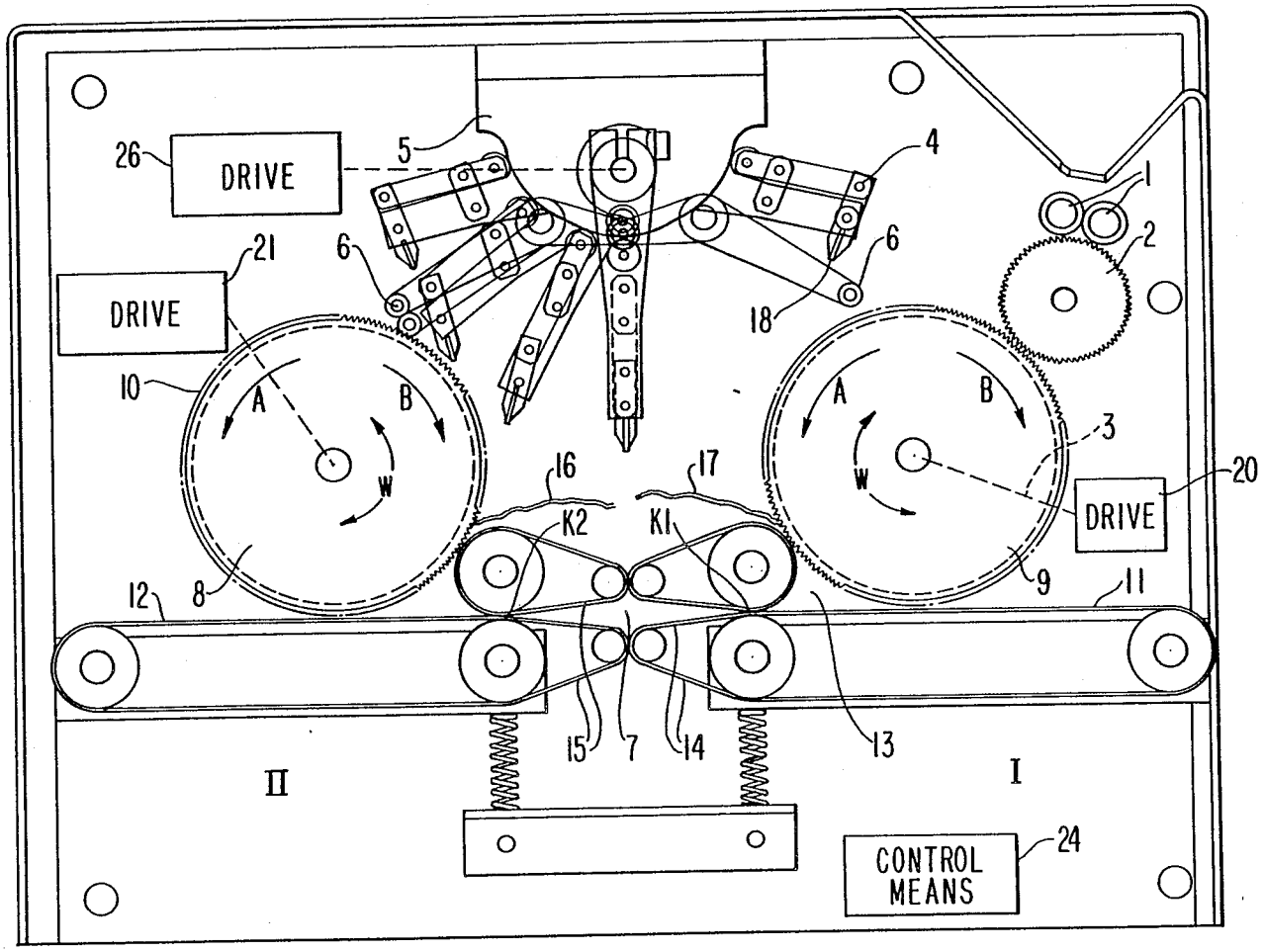

The FIGURE shows a preferred apparatus for implementing the method of the invention and includes first and second cylindrical carding drums 3 and 8 selectively driven by conventional drive means 20 and 21, respectively, in either direction of rotation as illustrated by arrows A and B. Each carding drum is provided respectively with carding needles 9 and 10 mounted on the drum surfaces. A feed device 1, 2 feeds the first carding drum 3 with a pre-measured amount of tangled fiber material. A stretching device, or stretcher, 7 is mounted between the first and second carding drums 3, 8, and the upper surface of a first conveyor belt 11, driven bidirectionally, moves the fiber web between the first carding drum 3 and the stretching device 7. The upper surface of a second conveyor belt 12, also driven bidirectionally, moves the fiber web between the second carding drum 8 and the stretching device 7. A separating device 4 is mounted for oscillating movement between the two carding drums 3, 8 and is shown in the FIGURE in various positions which it occupies at various times during the operating cycle of the apparatus. A control system 24 controls the energization and direction of the various drives to assure the cooperation of the components of the apparatus.

The individual steps of the method of the invention are described below in relation to this preferred apparatus.

STEP A (feeding)

The tangled, pre-measured amount of fiber material—for instance, cotton in flock form—moves over the pair of feeding rollers 1 and a cooperating unraveling roller 2 to the first carding drum 3. By predrawing between the pair of feeding rollers 1 and the carding unraveling roller 2, both an opening and preparallelization of the fiber material are accomplished.

The fiber material so pre-oriented is deposited in web form on the carding needles 9 at the cylindrical surface of carding drum 3. In this step, the first carding drum 3 rotates in the direction A until the feeding has been completed. Thereupon the apparatus is stopped for the next step. Preferably the pair of feeding rollers 1 and the cooperating unraveling roller 2 are motor-driven and controlled electronically, though in principle manual operation is also feasible.

STEP B (detaching and unraveling the fiber web)

The fiber web, still largely closed at this stage, and accumulated on the card needles 9 on the drum surface must be unraveled rectilinearly in order to be drawn into the stretching device 7 along a surface generatrix of the first carding drum 3. For that purpose, the separating comb 4, which is mounted for oscillatory movement between the two carding drums 3, 8, and driven by a drive means 26 pierces the fiber web and detaches a portion which becomes an end of the detached web by means of a motion predetermined by the separation cam 5. The needles 18 of the separation comb pierce the fiber web and lift it off of carding drum 3. Thereby the web is interrupted and extends between the retaining site 6 and the needles 18. The separation cam 5 and the lever movement of the separation comb 4 which, in the preferred embodiment, is a parallelogram linkage, now make the separation comb 4 pivot in such a way that the leading end of the fiber web 16, 17 slides out of the needles 18. During the separation, the trailing end of the web is held by depressor 6 against the first carding drum 3.

STEPS C and D (pulling the fiber web into the stretching device)

The leading end of the web, which projects on account of the separation procedure from the surface of the first carding drum 3, is moved by the drum rotation in direction A by an angle w (the precise magnitude of this angle depends on the geometry of the particular apparatus and may be easily ascertained empirically) into the stretcher-intake position 13.

Next the direction of rotation of the first carding cloth drum 3 is changed from A to B, the hooks of the cloth carding 9 assuming the doffing position and the leading end of the web lifted off the drum surface is carried along by the conveyor upper belt 11 and is inserted into the stretching device.

The fiber web presently passes through the symmetrical 4-belt stretcher 7, with positive drawing taking place between the clamping points K1 and K2. The drawing magnitudes, that is the difference between the circumferential speeds of the belts 14 of the right-hand apparatus part I and the belts 15 of the left-hand apparatus part II can be freely selected and is preferably twice the motion to or from.

STEP E (doubling the fiber web)

The web lifted off according to Step C and of which the length is determined by the drum circumference of the first carding drum 3 is extended in the stretching device 7 by the factor "x" (a selected stretch factor)—for instance being doubled in length. The web so extended then is wound several times on the second carding drum 8 rotating in the direction B, in other words it is doubled over. The carding hooks of the card clothing 10 assume the receiving position.

STEPS F–H (Repetition of the procedure, but in mirror-reversed manner)

Once the entire quantity of fiber present in the apparatus has been moved onto the second carding drum 8, the motion of that drum is stopped and the web is detached and wound off similarly to steps B and C and again is drawn with the new leading end similarly to step E into the stretching device 7 and stretched. Accordingly, the procedure takes place in fully analogous manner from the machine side II to the machine side I. Subsequently, the fiber material is subjected to repeated cycles of stretching-doubling-stretching until a degree of parallelization sufficient for the particular application has been reached.

What is claimed is:

1. A method for making fiber slivers with parallelized fibers from sets of tangled fibers, comprising the sequential steps of (a) feeding and winding a predetermined quantity of tangled fiber material onto a first carding drum (3) to form thereon a fiber web, (b) detaching an end of the fiber web annularly wound on the first carding drum creating a free end (3) at a selected site, (c) winding off the fiber web from the first carding drum (3) by the detached free end of the fiber web, (d) stretching the fiber web by a factor "x", (e) winding the stretched fiber web onto a second carding drum (8), (f) detaching the fiber web from the second carding drum (8) at a selected site, (g) winding off the fiber web from the second carding drum (8) by the detached free end of the fiber web, (h) stretching the fiber web by the factor "x", (i) again winding the stretched fiber web onto the first carding drum (3), (j) repeating steps (b) through (i) until sufficient parallelization of fibers has taken place, and then, (k) terminating an iteration cycle after a next step (g).

2. A method according to claim 1, and including, during the detaching procedure of Step (b), holding the trailing end of the fiber web against the first carding drum (3).

3. A method according to claim 2 wherein Step (a) includes pre-orienting the fibers while feeding the fiber web onto the first carding drum.

4. A method according to claim 3 wherein Step (e) includes folding over the stretched web onto itself on the second carding drum.

5. An apparatus for parallelizing fibers in a bundle of matted fibers comprising the combination of first and second cylindrical carding drums (3, 8) each having carding needles (9, 10) mounted on the cylinder surface, means for selectively driving either of said drums in either rotational direction; feed means (1, 2) for feeding to the first carding drum (3) a pre-measured amount of tangled fiber material, a stretching device (7) mounted between the first and second carding drums (3, 8), first conveyor belt means (11) for bidirectionally moving the fiber web between said first carding drum (3) and said stretching device (7), second conveyor belt means (12) for bidirectionally moving the fiber web between the second carding drum (8) and the stretching device (7), a separation device (4) mounted for oscillatory movement between said two carding drums (3, 8) and control means for activating and controlling said means for driving, said feed means, said stretching device and said conveyor belts in proper sequence.

6. An apparatus according to claim 5, wherein the separation device (4) comprises a separation comb displaceably movable along a path defined by a separation cam (5) for detaching a free end at a specific site the fiber web wound onto the carding drums (3, 8) while leaving a trailing end and unwinding the unraveled fiber web from the carding drums (3, 8) by means of the detached free end of the fiber web along a generatrix of the carding drums (3, 8).

7. An apparatus according to claim 6, and further comprising a depressing device (6) to hold the trailing end of the fiber web against said carding drum (3 or 8) during the separation of said web from said drum.

8. An apparatus according to claim 5, and further comprising a depressing device (6) for holding a trailing end of the fiber web against said carding drum (3 or 8) during the separation of said web from said drum.

* * * * *